US012606882B2

(12) United States Patent
Benedetti et al.

(10) Patent No.: US 12,606,882 B2
(45) Date of Patent: Apr. 21, 2026

(54) PROCESS FOR MANUFACTURING COMPACT COILS OF ULTRA-FINE GRAINED, MARTENSITE-FREE STEEL BARS

(71) Applicant: DANIELI & C. OFFICINE MECCANICHE S.p.A., Buttrio (IT)

(72) Inventors: Gianpietro Benedetti, Tricesimo (IT); Claudio Fabbro, Trieste (IT); Maicol Cimolino, Martignacco (IT); Simone Ferrarese, Trieste (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 578 days.

(21) Appl. No.: 18/003,892

(22) PCT Filed: Jul. 2, 2021

(86) PCT No.: PCT/EP2021/068416
§ 371 (c)(1),
(2) Date: Dec. 29, 2022

(87) PCT Pub. No.: WO2022/003194
PCT Pub. Date: Jan. 6, 2022

(65) Prior Publication Data

US 2023/0257848 A1 Aug. 17, 2023

(30) Foreign Application Priority Data

Jul. 3, 2020 (IT) ..... 102020000016153

(51) Int. Cl.
*C21D 11/00* (2006.01)
*C21D 6/00* (2006.01)
(Continued)

(52) U.S. Cl.
CPC ..... *C21D 11/00* (2013.01); *C21D 6/005* (2013.01); *C21D 6/008* (2013.01); *C21D 8/065* (2013.01);
(Continued)

(58) Field of Classification Search
CPC ..... C21D 11/00; C21D 6/005; C21D 6/008; C21D 8/065; C21D 1/60; C21D 1/62;
(Continued)

(56) References Cited

U.S. PATENT DOCUMENTS 6,719,860 B1 * 4/2004 Leionen ..... C21D 8/0226 148/653
9,308,563 B2 * 4/2016 Ota ..... B21B 37/76
(Continued)

FOREIGN PATENT DOCUMENTS

CN 1718770 A 1/2006
CN 101456032 A 6/2009
(Continued)

OTHER PUBLICATIONS

Skorokhvatov N B, et.al. [RU2262537C1] (Text relied on Machine translation) (Year: 2004).*
(Continued)

*Primary Examiner* — Sally A Merkling
*Assistant Examiner* — Nazmun Nahar Shams
(74) *Attorney, Agent, or Firm* — Stetina Garred Brucker & Newboles

(57) ABSTRACT

A process comprising: rolling a steel billet via a roughing rolling mill and producing a steel bar; performing a first cooling stage so that the steel bar has a surface temperature higher than the martensite start temperature, and performing a first equalization stage in air; rolling the steel bar via an intermediate rolling mill; performing a second cooling stage always maintaining the surface temperature higher than the
(Continued)

martensite start temperature, and performing a second equalization stage in air; rolling the steel bar via a finishing rolling mill in a non-recrystallization temperature range, maintaining the whole cross-section of the steel bar within said non-recrystallization temperature range, and with a total reduction between 25 and 50% with respect to the cross-section of the steel bar at the entry of the finishing rolling mill, in order to obtain an ultra-fine-grained austenitic matrix; winding the steel bar in a compact coil so that the ultra-fine-grained austenitic matrix transforms in a mixture of ferrite and pearlite.

17 Claims, 8 Drawing Sheets

(51) Int. Cl.

| | |
|---|---|
| ***C21D 8/06*** | (2006.01) |
| ***C21D 9/00*** | (2006.01) |
| ***C22C 38/02*** | (2006.01) |
| ***C22C 38/04*** | (2006.01) |
| ***C22C 38/12*** | (2006.01) |

(52) U.S. Cl.
CPC ..... *C21D 9/0068* (2013.01); *C22C 38/02* (2013.01); *C22C 38/04* (2013.01); *C22C 38/12* (2013.01)

(58) Field of Classification Search
CPC ..... C21D 9/5732; C21D 11/005; C21D 2211/005; C21D 8/08; C21D 2211/009; C21D 9/0068; C22C 38/02; C22C 38/04; C22C 38/12
USPC ..... 148/511
See application file for complete search history.

(56) References Cited

U.S. PATENT DOCUMENTS

| | | | | |
|---|---|---|---|---|
| 2010/0175452 | A1* | 7/2010 | Ohlert ..... | C21D 9/48 72/200 |
| 2014/0261915 | A1 | 9/2014 | Ehrhardt et al. | |

FOREIGN PATENT DOCUMENTS

| | | | | |
|---|---|---|---|---|
| CN | 103103437 | A | * | 5/2013 |
| CN | 107419078 | A | | 12/2017 |
| CN | 107747061 | A | | 3/2018 |
| WO | 0129272 | A1 | | 4/2001 |

OTHER PUBLICATIONS

Wang Lijuan et.al. [CN103103437A] (Machine translation) (Year: 2013).*

Chinese Office Action for 202180047575.7; mailed Jun. 8, 2025.

Patent Cooperation Treaty, International Search Report and Written Opinion for International Application No. PCT/EP2021/068416, mailed Sep. 24, 2021, 12 pages.

* cited by examiner

A: Conventional rolling

B: Normalizing rolling

C: Thermo-mechanical rolling

PROCESS FOR MANUFACTURING COMPACT COILS OF ULTRA-FINE GRAINED, MARTENSITE-FREE STEEL BARS

CROSS-REFERENCE TO RELATED APPLICATIONS

This application claims priority to PCT International Application No. PCT/EP2021/068416 filed on Jul. 2, 2021, which application claims priority to Italian Patent Application No. 102020000016153 filed on Jul. 3, 2020, the entire disclosures of which are expressly incorporated herein by reference.

STATEMENT RE: FEDERALLY SPONSORED RESEARCH/DEVELOPMENT

Not Applicable

BACKGROUND

Field of the Invention

The present invention relates to a process for manufacturing compact coils of ultra-fine grained, martensite-free steel bars.

Background

The process of spooling the ribbed steel bars in compact coils is a big step ahead in storage, transport, handling, compared to the straight bar production.

The spooling process can be applied to ribbed steel bars with diameters ranging from 6 to 40 mm, for example from 6 to 32 mm, as well to smooth rounds.

The compact coils are unwound by means of machines which can both straighten the ribbed bar at room temperature, as well as to create rebar stirrups.

The spooling process is performed as shown in FIGS. 1 and 2, where a cooling is applied to the product coming out of the last finishing rolling step.

This cooling can be applied in two different solutions.

The most common solution (FIGS. 1 and 8) foresees a single cooling step after the last finishing rolling pass, with high cooling speed, to obtain quenching in the surface area of the bar. This process is commonly called QTS (Quenching Tempering in Spooler) and represents the typical solution for medium-high tensile grades (e.g. British Standard grades B500B, B500C; American standard grades Gr60, Gr80, Gr100).

The surface quenching results in a mixed martensitic-bainitic structure, because of suppression of the diffusive transformation of the austenite, due to the high cooling speed.

After the quenching step, the bar undergoes a step of equalization in air, in which the heat of the core spreads towards the surface area, tempering the martensitic-bainitic structure. The bar is then wounded into a spooler to form a compact coil.

Results on final product of this process solution is a compromise between mechanical strength (whose contribution is mainly from the surface area) and toughness (whose contribution is mainly from the mixed ferrite and pearlite of the core).

The composite structure obtained with the quenching and self-tempering allows to comply with the mechanical characteristics established by the various national and international standards for rebars, with a billet chemical composition poorer than those used typically for not-quenched ribbed bar production.

On the other hand, an aspect of this QTS process is that the high hardness of the surface area, when unwinding the coil, gives higher wear of the straightening machine equipment, compared to non-quenched material, and thus a rougher straightening operation.

Another common process (FIG. 2) is called Soft Quenching (SQ) and represents the ideal solution for high ductility weldable grades (e.g. European grades on classes B450C, B500B, B500C).

The target of the SQ process is to optimize the microstructure of the different steel grades avoiding undesirable grain growth and drastic cooling that would lead to a thick martensite layer.

In the SQ process, the cooling of the material is fractioned in multiple steps after the last finishing rolling stand and before the winding machine. The cooling steps are separated by equalizations spaces.

The final microstructure obtained with SQ process is different with respect to QTS traditional treatment. For the Soft Quenching the presence of mixture of tempered martensite and bainite on the surface is reduced compared to the QTS, but not avoided, maintaining the gradual transitioning to a mixture of ferrite and pearlite at the bar core.

However, an international market analysis shows that the use of quenched steel for rebar is not accepted in all markets, both as a consequence of local regulatory laws (for example China, Taiwan) and because, even in the absence of specific regulations, some markets do not accept quenched bars (for example Japan). This depends on the fact that the steel rebar is widely used as reinforcement for concrete in the civil construction of buildings. In particularly seismic areas such as China and Japan, these countries require bars with high ductility, given by a microstructure lacking the presence of fragile phases, such as martensite and bainite, typical of quenching treatment.

In particular, the newly revised Chinese national standard GB/T 1499.2018 (Steel for the reinforcement of concrete—part 2: Hot rolled ribbed bars) makes significant changes to the manufacture and supply of steel reinforcement bars for reinforced concrete in China, directly addressing the results obtained with poor-quality rebar material.

In order to guarantee the tight standard requirements or in any case to satisfy some markets requirements, additional alloying elements such as niobium (Nb), vanadium (V) and titanium (Ti) are necessary. However, the addition of the alloying elements mentioned above inevitably implies a significant increase in production costs.

SUMMARY OF THE INVENTION

It is an object of the present invention to develop a process for manufacturing compact coils of steel bars that allows production of ultra-fine grained, martensite-free and high ductility grades of spooled steel bars without addition of (or minimizing) microalloying elements (Nb, V, Ti), with lower production costs.

It is a further object of the present invention to produce a coil of steel bar having a microstructure with an grain size equal to or higher than 9 according to standard ASTM E112-13, and wherein the difference of hardness (HV, preferably HV 0,5, i.e. the Vickers hardness measured with load of 4.903 N) measured between surface and core of the steel bar is less or equal to 40 HV, for example in the range 10-40 HV.

The present invention achieves such objects and other objects, which will become apparent in the light of the present description, by means of a process for manufacturing coils of ultra-fine grained, martensite-free steel bars comprising the stages of claim 1.

According to a further aspect of the invention, a plant is provided for manufacturing compact coils of ultra-fine grained, martensite-free steel bars, the plant being suitable for carrying out said process, the plant comprising

- a roughing rolling mill for rolling a steel billet so as to obtain a steel bar;
- at least one first cooling device for cooling the steel bar and at least one first equalization space for performing at least one first equalization in air;
- at least one intermediate rolling mill for rolling the steel bar;
- at least one second cooling device for cooling the steel bar and at least one second equalization space for performing at least one second equalization in air;
- a finishing rolling mill for rolling the steel bar;
- at least one winding device for winding the steel bar in a compact coil.

Advantageously, the steel bars treated with the process of the invention do not have the characteristic microstructure obtained by means of quenched surface processes (i.e. an outer ring of martensite with a ferrite and pearlite core) but they present a microstructure composed exclusively of a mixture of ferrite and pearlite evenly distributed over the whole cross section of the bar. The mechanical properties are obtained thanks to the austenitic grain refinement produced using alternated cooling-equalizing-rolling stages, which can be synthetized as thermomechanical rolling. A small austenitic grain quickly transforms in a fine-grained ferritic-pearlitic texture. Comparing to the classic hot-rolled products, standing the same chemical composition, the ultra-fine grained product presents better mechanical properties, in particular a higher ductility. These cooling-equalizing-rolling stages can be repeated multiple times, using a variable number of cooling devices, for example cooling boxes, such as water boxes, that according to the plant throughput permit to reach the desired bar surface temperature at the entry of the finishing rolling stands group.

The heat treatment according to the invention is particularly suitable to produce compact coils of ribbed steel bars for concrete reinforcement, with Yield stress ranging from 200 to 1200 MPa, for example from 400 to 1000 MPa, or from 400 to 700 MPa for the most common composition ranges of low/medium carbon steel.

Optionally, a further contribution to the mechanical properties can also come from the subsequent unwinding and straightening operation (work hardening), and from a possible natural ageing. In this particular embodiment, the mechanical properties of the finished product are therefore obtained by means of a combination of thermomechanical rolling, heat treatment on the cooling line, straightening and possible ageing.

Below are some of the further advantages of the solution of the present invention with respect to the state of the art:

- it applies to all grades of concrete reinforcement ribbed bars;
- the absence of martensite and bainite ensures a better seismic resistance and less wear of the straightening machines;
- fine-grained microstructure allows for reduction or absence of microalloying elements, and savings in the production cost.

Further features and advantages of the invention will become more apparent in the light of the detailed description of illustrative, but non-exclusive embodiments.

The dependent claims describe particular embodiments of the invention.

BRIEF DESCRIPTION OF THE DRAWINGS

Reference is made in the description of the invention to the appended drawing tables, which are given by way of non-limiting examples, wherein.

DETAILED DESCRIPTION OF SOME ILLUSTRATIVE EMBODIMENTS OF THE INVENTION

Figure 1:
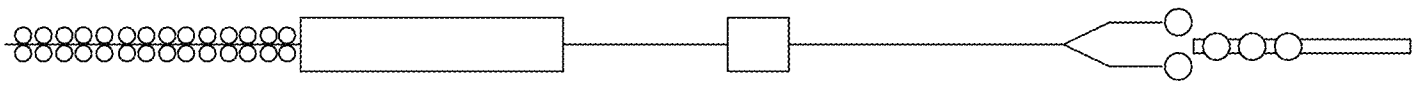
Fig. 1 Prior Art
FIG. 1 shows a first schematic layout of a plant for Quenching Tempering in Spooler according to the prior art.
Figure 2:
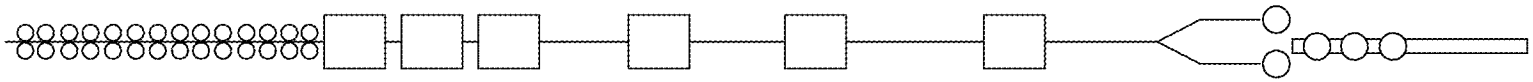
Fig. 2 Prior Art
FIG. 2 shows a second schematic layout of a plant for Soft Quenching according to the prior art.

The present invention relates to a process for manufacturing compact coils of steel bars that allows production of ultra-fine grained, martensite-free and high ductility grades of spooled steel bars without addition of, or minimizing, microalloying elements with lower production costs.

In this description, the term "compact coil" means a coil having a filling coefficient higher than or equal to 65%, preferably in the range 65-74%, said filling coefficient being defined, considering the volume of the coil, as the ratio between density of the coil and theoretical density of the steel.

The term "ultra-fine grained", instead, means that the microstructure has an average grain size equal to or higher than 9 according to standard ASTM E112-13.

The steel bar of the coil produced by means the process of the invention can have a size (i.e. diameter) preferably in the range of 8-40 mm.

The coil weight is in the range 1.0-10.0 tons, preferably in the range from 2.0 to 8.0 tons.

FIGS. 3-6 show some embodiments of plant layout in which the process of the invention can be performed.

In all embodiments of the invention, the process for manufacturing compact coils of ultra-fine grained, martensite-free steel bars comprises the following steps:

a) rolling a steel billet with an initial surface temperature of 850-1200° C., preferably 900-1100° C., by means of a roughing rolling mill 1, producing a steel bar;

b) performing at least one first cooling stage 2 so that the steel bar has a surface temperature higher than the martensite start temperature Ms, and performing at least one first equalization stage in air to minimize the difference of temperature between core and surface of the steel bar until reaching the surface temperature in a range of 850-920° C.;

c) rolling the steel bar by means of at least one intermediate rolling mill 3, for example only one intermediate rolling mill;

d) performing at least one second cooling stage 4 always maintaining the surface temperature higher than the martensite start temperature Ms, and performing at least one second equalization stage in air to minimize the difference of temperature between core and surface of the steel bar until reaching the surface temperature in a range of 700-900° C., preferably of 750-840° C. or 750-820° C.;

e) rolling the steel bar by means of a finishing rolling mill 5 in a non-recrystallization temperature range, maintaining the whole cross-section of the steel bar within said non-recrystallization temperature range, and with a total reduction between 25 and 50% with respect to the cross-section of the steel bar at the entry of the finishing rolling mill 5, in order to obtain an ultra-fine-grained austenitic matrix;

f) winding the steel bar in a compact coil, by means at least one spooling device 7, for example two spooling devices 7, at a winding temperature in a range of 500-800° C., preferably 500-750 or 650-730° C., so that the ultra-fine-grained austenitic matrix transforms in a mixture of ferrite and pearlite.

The process of the invention can be performed according to the above mentioned steps, in the specific case of a low/medium carbon steel, in a plant with a throughput of 90-120 t/h.

The steel billet of step a) enters the roughing rolling mill 1 coming from either a reheating furnace, for example a gas furnace or an induction heater, or directly from a continuous casting machine (not shown). The surface temperature of the steel bar at the entry of the first group of rolling stands, i.e. the roughing rolling mill 1, is in the range 850-1200° C., preferably 900-1100° C.

Preferably, the steel billet is a billet of low or medium carbon steel.

Said low/medium carbon steel comprises or consists of, in weight percentage, carbon lower than or equal to 0,28%, silicon lower than or equal to 0,80%, manganese lower than or equal to 1,60%, the remaining being iron and unavoidable or possible impurities.

Preferably, the low/medium carbon steel comprises or consists of, in weight percentage, carbon in a range of 0,20-0,25%, silicon in a range of 0,20-0,70%, manganese in a range of 0,80-1,30%, possible vanadium in a range of 0,020-0,050%, the remaining being iron and unavoidable or possible impurities.

Two non-limiting examples of the steel composition are disclosed in the following table for a steel bar having a size (diameter) of 8-40 mm.

| Grade | Size (mm) | C (%) | Si (%) | Mn (%) | V (%) |
|---|---|---|---|---|---|
| HRBF400E | 8-40 | 0.20-0.24 | 0.20-0.60 | 0.80-1.20 | — |
| HRBF500E | 8-40 | 0.20-0.24 | 0.30-0.70 | 0.90-1.30 | 0.020-0.050 |

In an embodiment of the process, after the roughing rolling mill 1, the steel bar is cooled by means of at least one first cooling stage 2 so that the surface thereof does not reach the martensite start temperature (Ms), that can be calculated as per the formula $$Ms(^\circ C.)=512-453*C-16,9*Ni+15*Cr-9,5*Mo+217*C^2-71,5*(C*Mn)-67,6*(C*Cr),$$

or, simply, $Ms(^\circ C.)=512-453*C+217*C^2-71,5*(C*Mn)$.

An air equalization space is provided between said at least one first cooling stage 2 and the following intermediate rolling mill 3.

In a variant there is provided only one first cooling stage 2 (as shown in the FIGS. 3-6), and only one first equalization stage in air is provided between the first cooling stage 2 and the intermediate rolling mill 3. Alternatively, there are provided at least two first cooling stages 2, and one first equalization stage in air is provided both between the at least two first cooling stages 2 and between the last first cooling stage 2 and the intermediate rolling mill 3. For example, there are provided two first cooling stages 2, and a respective first equalization stage in air is provided both between the two subsequent first cooling stages 2 and between the last first cooling stage 2 and the intermediate rolling mill 3.

At least two second cooling stages 4 are provided after the intermediate rolling mill 3 for a higher bar surface temperature reduction, but always maintaining the surface temperature above Ms. One second equalization stage in air is provided both between the at least two second cooling stages 4 and between the last second cooling stage 4 and the finishing rolling mill 5. In said step d) no microstructural modification occurs, and both the surface and the core of the bar remain completely in the austenitic phase.

Preferably there are provided two or three second cooling stages 4, and a respective second equalization stage in air is provided between two subsequent second cooling stages 4 and between the last second cooling stage 4 and the finishing rolling mill 5. Therefore, if two second cooling stages 4 are provided there will be two second equalization stages in air. Instead, if three second cooling stages 4 are provided there will be three second equalization stages in air.

Optionally, the equalization spaces between two subsequent second cooling stages 4 can vary from 8 to 25 m, according to the plant throughput; instead, the equalization space between the last second cooling stage and the following finishing rolling mill 5 can vary between 25 and 50 m according to the plant throughput.

Preferably, the cooling-equalizing-intermediate rolling stages can be repeated multiple times, and with a variable number of second cooling stages 4 according to the plant throughput to reach the desired bar surface temperature at the entry of the finishing rolling mill 5. In this case more than one intermediate rolling mill 3 is provided. The additional intermediate rolling mills 3 are provided between two respective subsequent second cooling stages 4, in particular between the equalization space, provided after a cooling stage 4, and the subsequent cooling stage 4.

Thanks to the cooling applied in the second cooling stages 4, the surface temperature is gradually reduced until reaching the range 700-900° C., preferably of 750-840° C. or 750-820° C., at the entry of the finishing rolling mill 5.

Figure 7:
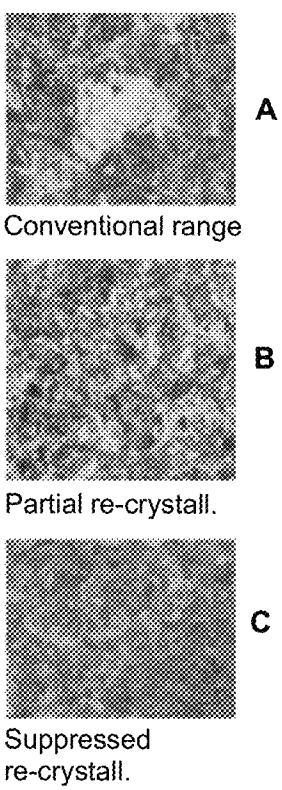
FIG. 7 shows a schematic Fe-C diagram, with highlighted the Carbon and temperature range in which thermomechanical rolling is applicable.
Figure 7:
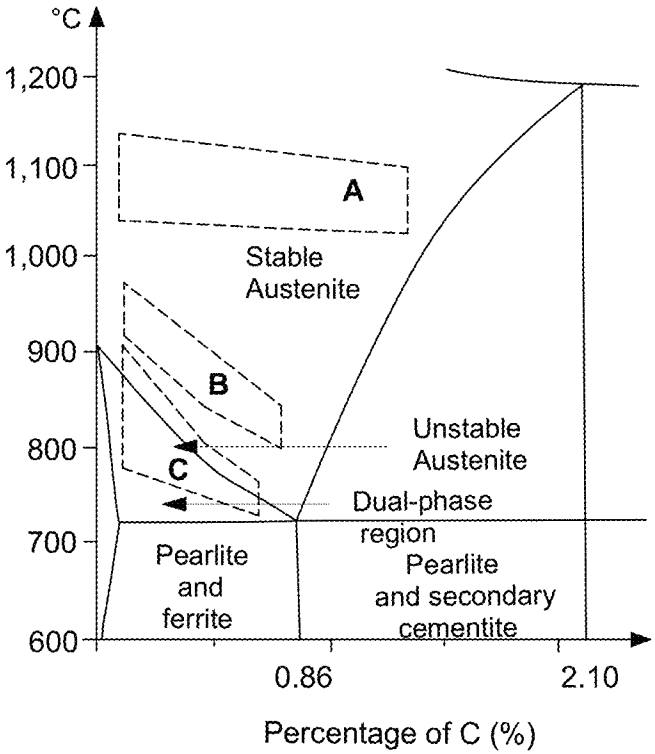

During all the finishing rolling passes, the bar surface temperature is maintained inside the non-recrystallization range (see for example FIG. 7), for example 750-850° C. or 750-840° C. or 750-820° C. This means that the austenitic grain size is reduced applying a high reduction (25-50% total reduction on the finishing stands group), and the recrystallization and growth of austenite are suppressed by the lack of available thermal energy. FIG. 7, in particular, show a schematic Fe-C diagram, with highlighted the Carbon and temperature ranges (zone C) in which thermomechanical rolling without recrystallization is applicable.

Advantageously, the number of finishing rolling passes should be lower than or equal to four. A higher number of rolling passes may give temperature growth inside the rolled bar, that can jeopardize the microstructural process.

At the exit of the finishing rolling mill 5, as a result of the austenitic grain size refinement and of the subsequent possible controlled cooling, the final grain size is ultra-fine, resulting in values equal to or above 9, as per standard ASTM E112-13.

The absence of fragile phases, such as martensite and bainite, has been certified by the reduced difference of hardness (HV, preferably HV 0,5, i.e. the Vickers hardness measured with load of 4.903 N) measured between surface and core of the steel bar. Such difference is advantageously less than or equal to 40 HV, preferably in the range 10-40 HV.

Preferably, between the finishing rolling step e) and the winding step f), there are provided at least one third cooling stage 6 and at least one third equalization stage in air to minimize the difference of temperature between core and surface of the steel bar, always avoiding martensite formation, until reaching the predetermined winding temperature.

In a variant, there are provided at least two third cooling stages 6, and one third equalization stage in air is provided both between the at least two third cooling devices stages 6 and between the last third cooling stage 6 and the at least one spooling device 7.

Anyway, the one or more third cooling stages 6 are optional. These cooling stages 6 can be avoided if the bar surface temperature, coming out from the finishing rolling mill 5, is appropriate for the winding operation.

Preferably, when provided, the third cooling stages 6 are in number comprised from two to six.

The number and distance between two subsequent cooling stages 6 depend on the plant throughput. Said distance can be always equal (as shown in FIGS. 3-6) or different.

One or more cooling stages 6 can be used to obtain different winding temperatures along the same steel bar in order to uniform the cooling profile of different coil layers and limit as much as possible the spread of mechanical properties. Optionally, in the winding step first and last coil layers are wound at 20-50° C. warmer than the rest of the coil layers. The reference temperature range for the winding operation is 500-800° C., preferably 650-730° C., including the higher temperatures for the first and last coil layers.

Figure 3:
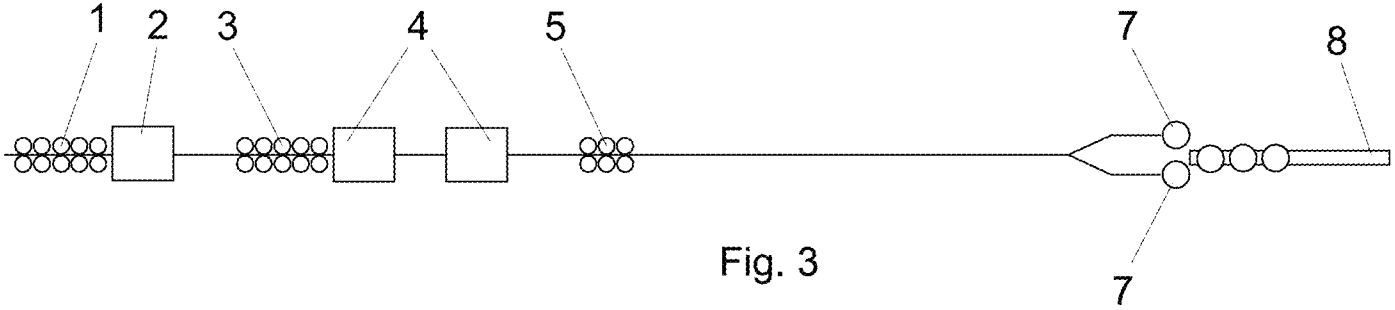
FIG. 3 shows a first embodiment of a plant on which the process of the invention is performed.

In a first embodiment, shown in FIG. 3, no cooling stage 6 is provided. Only one cooling stage 2 and two cooling stages 4 are provided.

Figure 4:
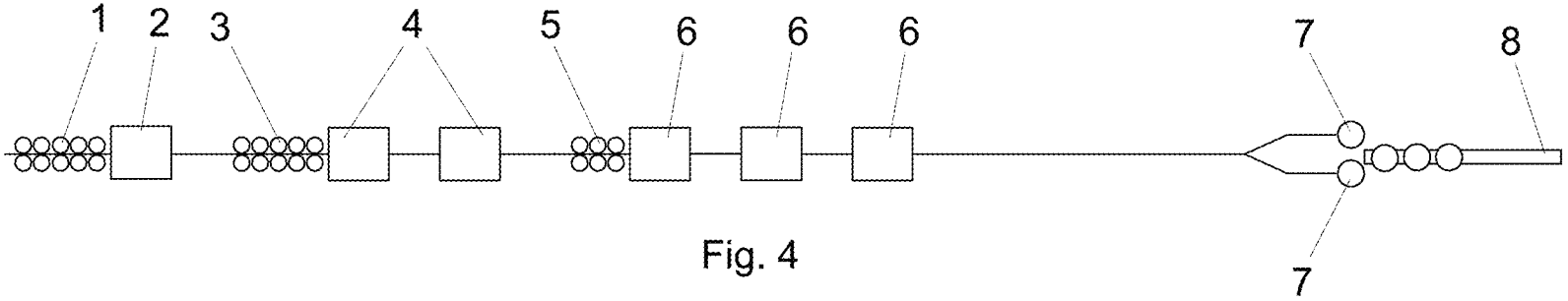
FIG. 4 shows a second embodiment of a plant on which the process of the invention is performed.

In a second embodiment, shown in FIG. 4, three cooling stages 6 are provided.

Figure 5:
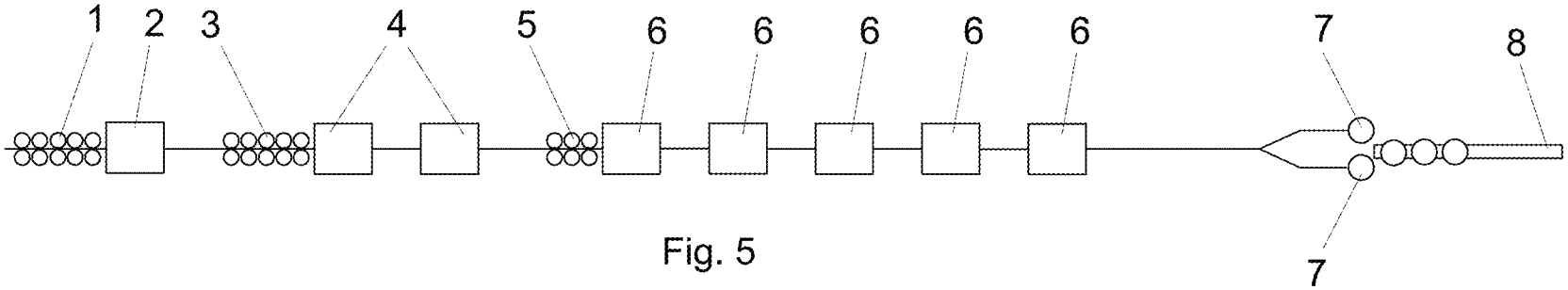
FIG. 5 shows a third embodiment of a plant on which the process of the invention is performed.

In a third embodiment, shown in FIG. 5, five cooling stages 6 are provided.

Figure 6:
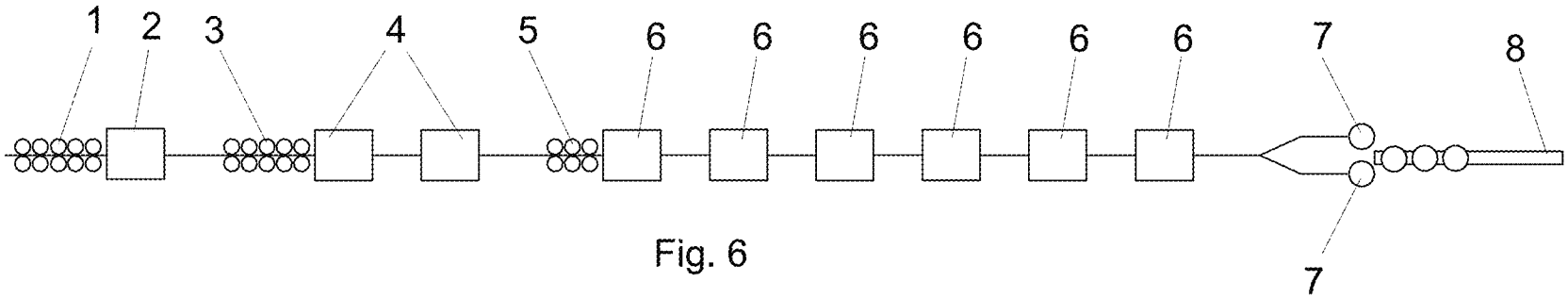
FIG. 6 shows a fourth embodiment of a plant on which the process of the invention is performed.

In a fourth embodiment, shown in FIG. 6, six cooling stages 6 are provided.

In these embodiments of FIGS. 3-6 only one cooling stage 2 and two (alternatively three) cooling stages 4 are provided.

FIGS. 9, 10, 11 and 12 show cooling curves 20, 21, 22 (surface temperature, average temperature and core temperature) of steel bars subjected to a thermal treatment according to the invention along the layout of FIGS. 3, 4, 5 and 6, respectively.

The horizontal dotted line represents a martensite start temperature Ms at about 500° C.

Figure 8:
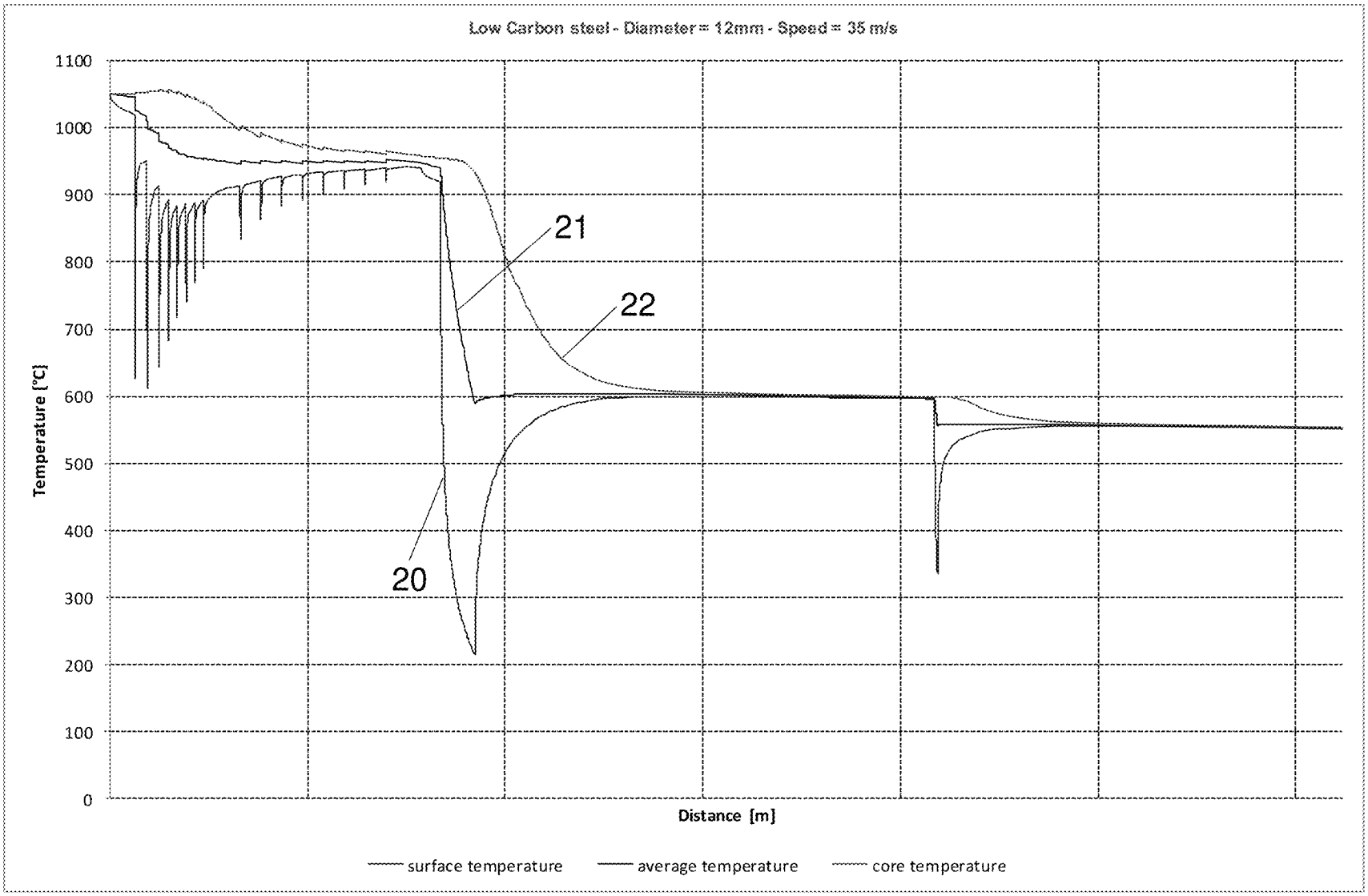
Fig. 8 Prior Art
FIG. 8 shows the cooling curves (surface temperature, average temperature and core temperature) of steel bars subjected to a known thermal treatment along the layout of FIG. 1.
Figure 9:
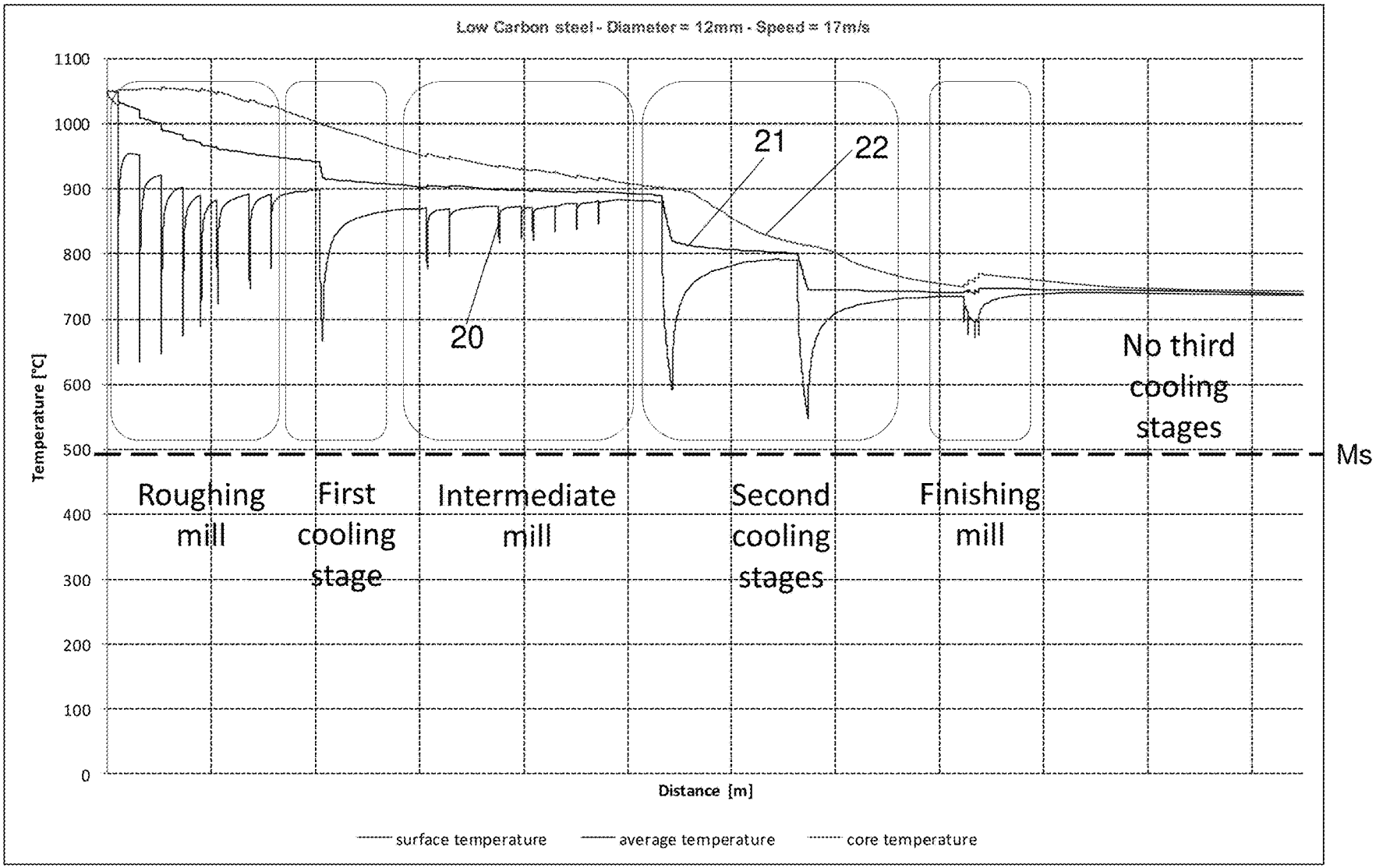
FIG. 9 shows the cooling curves (surface temperature, average temperature and core temperature) of steel bars subjected to a thermal treatment according to the invention along the layout of FIG. 3.
Figure 10:
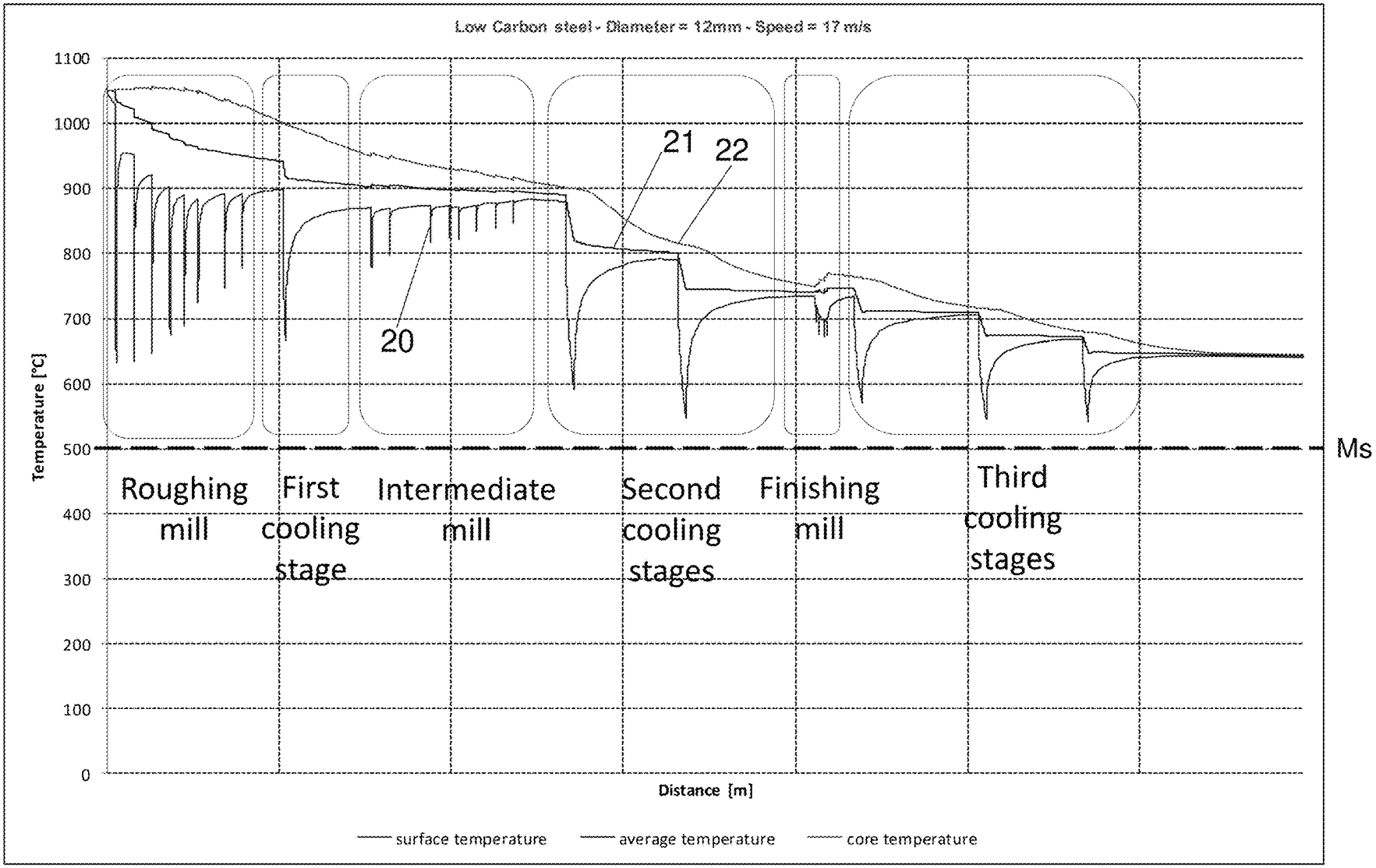
FIG. 10 shows the cooling curves (surface temperature, average temperature and core temperature) of steel bars subjected to a thermal treatment according to the invention along the layout of FIG. 4.
Figure 11:
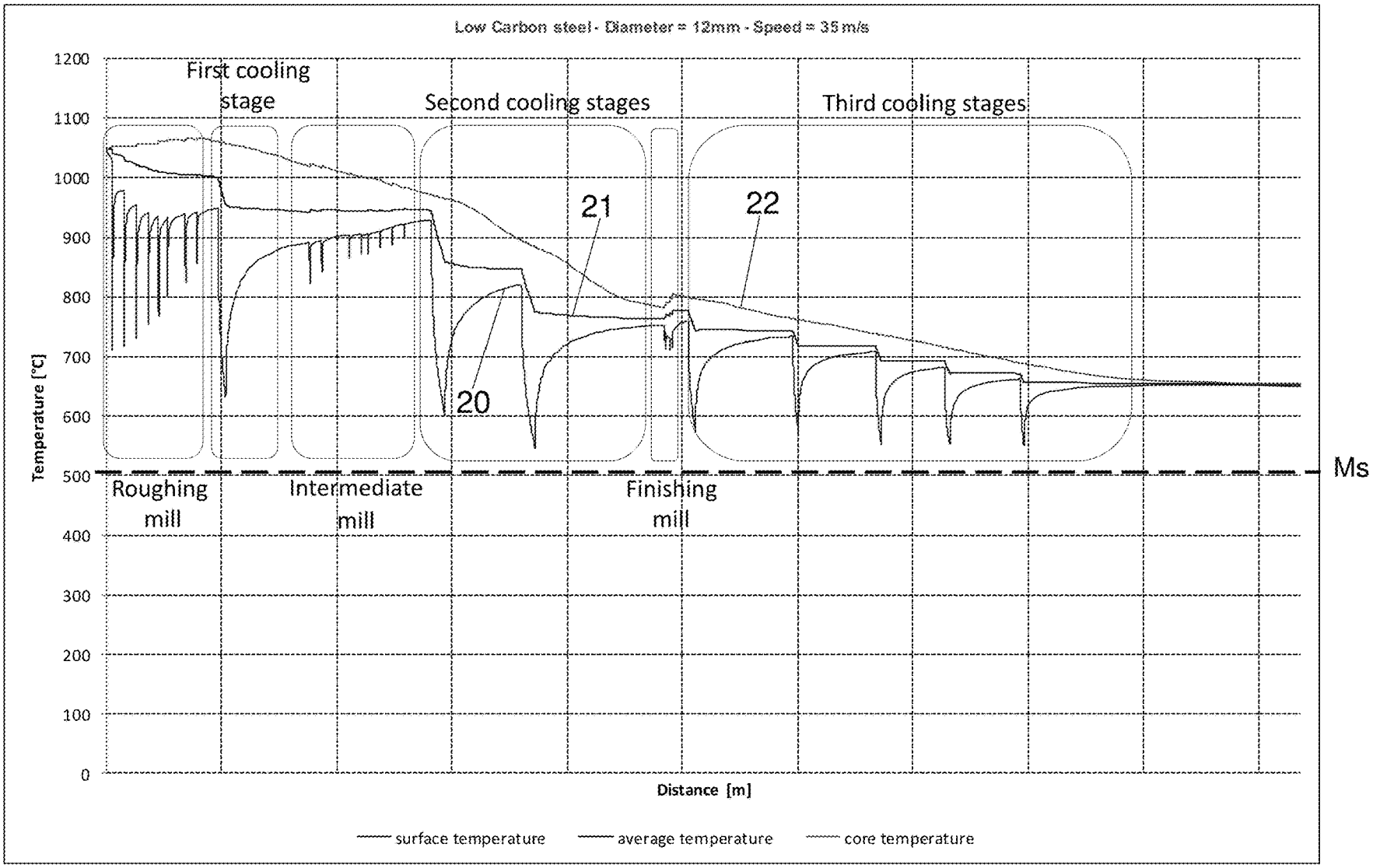
FIG. 11 shows the cooling curves (surface temperature, average temperature and core temperature) of steel bars subjected to a thermal treatment according to the invention along the layout of FIG. 5.
Figure 12:
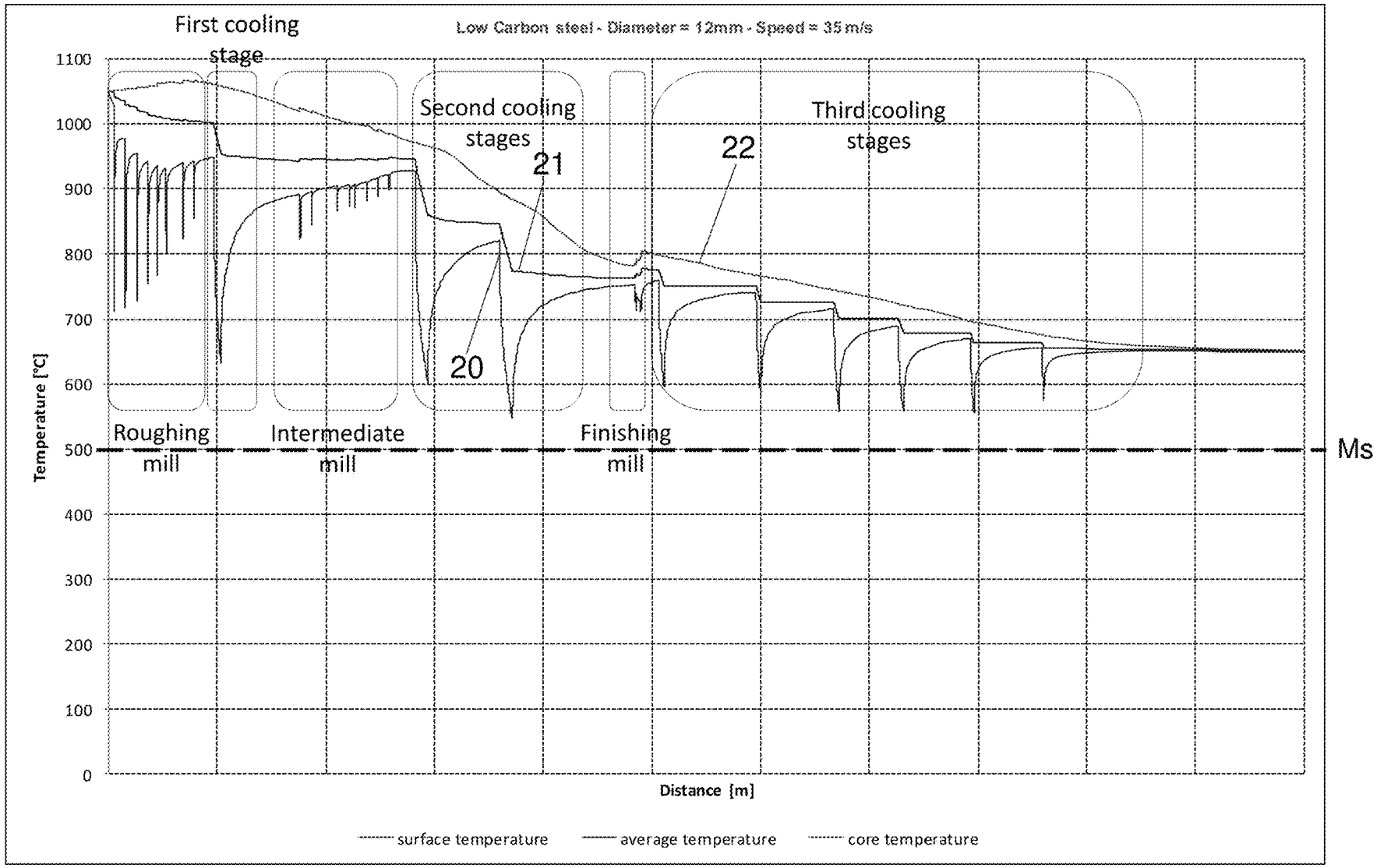
FIG. 12 shows the cooling curves (surface temperature, average temperature and core temperature) of steel bars subjected to a thermal treatment according to the invention along the layout of FIG. 6.

In all the steps of the process of the invention the surface temperature of the steel bar is always maintained above said martensite start temperature Ms, differently from the cooling curves of steel bars (see FIG. 8) subjected to a QTS thermal treatment along the layout of FIG. 1.

Preferably, at least one first cooling stage 2 is carried out by means of a respective first cooling device, at least one second cooling stage 4 is carried out by means of a respective second cooling device, and at least one possible third cooling stage 6 is carried out by means of a respective third cooling device.

As an example, first, second and third cooling stages are water cooling stages and first, second and third cooling devices are cooling boxes, for example water cooling boxes. Preferably, the work pressure used in all the cooling stages 2, 4, 6 is in the range of 0.2-0.6 MPa.

The distance between two subsequent cooling boxes can vary from 8 to 25 m, according to the plant throughput; whereas the distance between the last cooling box and the following rolling mill can vary between 25 and 50 m according to the plant throughput.

The number of cooling boxes and the distances between each other of them and between the last cooling box and the following group of rolling stands, depend on the line throughput and the steel grade to be treated. Downstream the last cooling box of the plant, two or more spooling devices 7 are provided for winding the material treated, for example on reels.

Optionally, in all the embodiments the surface temperatures of the steel bar can be monitored by means of sensors, for example pyrometers, installed both at entry and exit of each of roughing rolling mill 1, intermediate rolling mill 3 and finishing rolling mill 5. Operative parameters of said at least one first cooling stage 2, said at least one second cooling stage 4, and possibly of said at least one third cooling stage 6 can be managed through a closed-loop automatic control, operating in both feedforward and feedback control, based on readings of said sensors.

The number of cooling stages provided along the whole line makes it possible to adapt the intensity of cooling to the steel bar chemical composition, and to the final product required mechanical properties. In the same way, the chemical composition can be used to balance the necessity of achieving higher mechanical properties, but without exceeding with the cooling inside the cooling stages, or with the lowering of the rolling temperature. Micro alloyed steel billets can be used for this purpose.

During and immediately after the winding step, the ultra-fine-grained austenitic matrix transforms in a fine mixture of ferrite and pearlite. The result is a material that, compared with the spooled rebar with quenched surface, given the same final product yield strength, has a higher ductility.

After the winding operation is completed, the compact coil can be transferred to a storage area through a transferring device 8, for example a walking beam, where a natural or forced or retarded cooling is applied to the coil.

Preferably, the surface temperature of the coil when loaded on the transferring device 8 is in the range of 600-700° C.

Along the transferring device 8 the coil can be cooled by natural air convection, or its cooling profile can be modified using an appropriate equipment. The cooling profile can be accelerated using for example fans, by blowing air or air mist, installed along the transferring device 8, or it can be retarded using for example hoods, or active soaking furnaces, covering the transferring device. Modifying the coil cooling profile can be a helpful tool to further influence the morphology of the ferritic-pearlitic mixture.

Optionally, after a cooling to room temperature in the storage area, the coil can be unwound and straightened. This operation results in an increase of the yield and tensile strength (in a minor extent), and in a reduction of the fracture elongation. By means of the straightening parameters, it is possible to apply the work hardening in different extents. Anyway, the ductility of the steel bar remains satisfactory.

As an example, and in order to better understand the essence of the invention, below are provided some typical mechanical properties, that can be obtained in compliance with the GB 1499-2:2018 standard—grade HRBF400E:

| YS (MPa) | UTS (MPa) | El Agt (%) | UTS/YS | Grain Size | HV (0, 5) Surface-core Δ |
|---|---|---|---|---|---|
| 430-470 | 580-620 | >9.0 | >1.25 | >9.0 | ≤40 |

where

YS=Yield Stress;

UTS=Ultimate Tensile Stress;

El=fracture elongation.

The ratio between Ultimate Tensile Stress and Yield Stress gives an idea of the ductility of the material.

The invention claimed is:

1. A process for manufacturing compact coils of ultra-fine grained, martensite-free steel bars having a microstructure with an actual grain size equal to or higher than 9 according to standard ASTM E112-13, and wherein a difference of hardness (HV) measured between surface and core of the steel bar is less or equal than 40 HV, the process comprising the following stages:

a) rolling a steel billet with an initial surface temperature of 850-1200° C. by means of a roughing rolling mill producing a steel bar; wherein the steel billet is a billet of low or medium carbon steel consisting of, in weight percentage, carbon in a range of 0.20-0.25%, silicon in a range of 0.20-0.70%, manganese in a range of 0.80-1.30%, possible vanadium in a range of 0.020-0.050%, the remaining being iron and unavoidable or possible impurities;

b) performing at least one first cooling stage so that the steel bar has a surface temperature higher than the martensite start temperature (Ms), and performing at least one first equalization stage in air to minimize a difference of temperature between core and surface of the steel bar until reaching the surface temperature in a range of 850-920° C.;

c) rolling the steel bar by means of at least one intermediate rolling mill;

d) performing at least one second cooling stage always maintaining the surface temperature higher than the martensite start temperature (Ms), and performing at least one second equalization stage in air to minimize the difference of temperature between core and surface of the steel bar until reaching the surface temperature in a range of 700-900° C.;

e) rolling the steel bar by means of a finishing rolling mill in a non-recrystallization temperature range, maintaining a whole cross-section of the steel bar within said non-recrystallization temperature range, and with a total reduction between 25 and 50% with respect to a cross-section of the steel bar at an entry of the finishing rolling mill, in order to obtain an ultra-fine-grained austenitic matrix;

f) winding the steel bar in a compact coil, by means at least one spooling device, at a winding temperature in a range of 500-800° C. so that the ultra-fine-grained austenitic matrix transforms in a mixture of ferrite and pearlite.

2. The process according to claim 1, wherein in step d) there are provided at least two second cooling stages and one second equalization stage in air is provided both between the at least two second cooling stages and between the last second cooling stage and the finishing rolling mill.

3. The process according to claim 1, wherein in step b) there are provided at least two first cooling stages and one first equalization stage in air is provided both between the at least two first cooling stages and between the last first cooling stage and the at least one intermediate rolling mill.

4. The process according to claim 1, wherein, between step e) and step f), there are provided at least one third cooling stage and at least one third equalization stage in air to minimize the difference of temperature between core and surface of the steel bar until reaching said winding temperature.

5. The process according to claim 4, wherein there are provided at least two third cooling stages and one third equalization stage in air is provided both between the at least two third cooling devices stages and between the last third cooling stage and the at least one spooling device.

6. The process according to claim 1, wherein the at least one first cooling stage is carried out by means of a respective first cooling device, and the at least one second cooling stage is carried out by means of a respective second cooling device.

7. The process according to claim 1, wherein in step e) a number of finishing rolling passes is lower than or equal to four.

8. The process according to claim 1, wherein surface temperatures of the steel bar are monitored by means of sensors, installed both at entry and exit of each of roughing rolling mill, intermediate rolling mill and finishing rolling mill, and operative parameters of said at least one first cooling stage and said at least one second cooling stage are managed through a closed-loop automatic control, operating in both feedforward and feedback control, based on readings of the sensors.

9. The process according to claim 1, wherein after step f) the compact coil is transferred to a storage area through a transferring device along which a natural or forced or retarded cooling is applied to the compact coil.

10. The process according to claim 9, wherein, after a cooling to room temperature in the storage area, the compact coil is unwound and straightened and the natural ageing of the steel bar is performed at room temperature.

11. The process according to claim 1, wherein the steel billet enters the roughing rolling mill coming from either a reheating furnace or directly from a continuous casting machine.

12. The process according to claim 4, wherein the at least one first cooling stage (2) is carried out by means of a respective first cooling device, and the at least one second cooling stage (4) is carried out by means of a respective second cooling device; and wherein the at least one third cooling stage is carried out by means of a respective third cooling device.

13. The process according to claim 4, wherein surface temperatures of the steel bar are monitored by means of sensors, installed both at entry and exit of each of roughing rolling mill, intermediate rolling mill and finishing rolling mill, and operative parameters of said at least one first cooling stage and said at least one second cooling stage are managed through a closed-loop automatic control, operating in both feedforward and feedback control, based on readings of the sensors;

and wherein also operative parameters of said at least one third cooling stage are managed through said closed-loop automatic control.

14. The process according to claim 5, wherein there are provided third cooling stages in a number comprised from two to six.

15. The process according to claim 6, wherein a work pressure of first and second cooling devices is in the range of 0.2-0.6 MPa.

16. The process according to claim 7, wherein in step f) first and last coil layers are wounded at 20-50° C. hotter than the rest of the coil layers.

17. The process according to claim 9, wherein a surface temperature of the coil when loaded on the transferring device is in the range of 600-700° C.

* * * * *